US009005866B2

(12) United States Patent
Cheng et al.

(10) Patent No.: US 9,005,866 B2
(45) Date of Patent: Apr. 14, 2015

(54) TONER AND METHOD FOR ITS PREPARATION

(75) Inventors: Lanlan Cheng, Zhuhai (CN); Xiushan Zhang, Zhuhai (CN); Fugen Tang, Zhuhai (CN)

(73) Assignee: ICMI (China) Limited (CN)

( * ) Notice: Subject to any disclaimer, the term of this patent is extended or adjusted under 35 U.S.C. 154(b) by 175 days.

(21) Appl. No.: 13/820,014

(22) PCT Filed: May 31, 2011

(86) PCT No.: PCT/CN2011/075025

§ 371 (c)(1),
(2), (4) Date: Jun. 3, 2013

(87) PCT Pub. No.: WO2012/028005

PCT Pub. Date: Mar. 8, 2012

(65) Prior Publication Data

US 2013/0316281 A1 Nov. 28, 2013

(30) Foreign Application Priority Data

Aug. 31, 2010 (CN) ..... 2010 1 0267497

(51) Int. Cl.
*G03G 9/093* (2006.01)
*G03G 9/08* (2006.01)

(52) U.S. Cl.
CPC ..... *G03G 9/09392* (2013.01); *G03G 9/093* (2013.01); *G03G 9/09307* (2013.01); *G03G 9/09314* (2013.01); *G03G 9/0935* (2013.01); *G03G 9/0825* (2013.01); *G03G 9/0827* (2013.01)

(58) Field of Classification Search
USPC ..... 430/137.14, 110.1
See application file for complete search history.

(56) References Cited

U.S. PATENT DOCUMENTS

| | | | | |
|---|---|---|---|---|
| 5,185,226 | A | 2/1993 | Grosso et al. | |
| 5,204,208 | A | 4/1993 | Paine et al. | |
| 2009/0011347 | A1 * | 1/2009 | Daimon et al. | 430/48 |

FOREIGN PATENT DOCUMENTS

| | | | |
|---|---|---|---|
| CN | 1914257 | A | 2/2007 |
| CN | 101238168 | A | 8/2008 |
| CN | 101373344 | A | 2/2009 |
| CN | 101950133 | A | 1/2011 |
| JP | 60088959 | A | 5/1985 |
| JP | 02-062558 | A | 3/1990 |

OTHER PUBLICATIONS

International Search Report for Application No. PCT/CN2011/075025 dated Sep. 15, 2011.

* cited by examiner

*Primary Examiner* — Peter Vajda
(74) *Attorney, Agent, or Firm* — Lerner, David, Littenberg, Krumholz & Mentlik, LLP

(57) ABSTRACT

Disclosed are a toner and a preparation method thereof. The toner of the invention has honeycomb-shaped core-shell structured particles. The honeycomb-shaped core-shell structured particles comprise two or more core layers. Each core layer is completely covered by a shell layer.

7 Claims, 2 Drawing Sheets

TONER AND METHOD FOR ITS PREPARATION

CROSS-REFERENCE TO RELATED APPLICATIONS

The present application is a national phase entry under 35 U.S.C. §371 of International Application No. PCT/CN2011/075025 filed May 31, 2011, published in English, which claims priority from Chinese Patent Application No. 201010267497.5 filed Aug. 31, 2010, all of which are incorporated herein by reference.

FIELD OF THE INVENTION

The invention relates to a toner and its preparation method. More particularly, the invention relates to a core-shell structured toner and its preparation method.

BACKGROUND OF THE INVENTION

In the electrophotographic or electrostatic recording processes, developers are used in forming electrostatic images or electrostatic latent images. The electrostatic images can be formed by two-component developers composed of a toner and carrier particles or by one-component developers composed of only a toner but no carrier particles. One-component developers include magnetic one-component developers containing magnetic powder and non-magnetic one-component developers containing no magnetic powder.

Recently, many core-shell structured toners have been developed. These toners have colorant-containing core layers and shell layers covering the core layers. The core-shell structured toners can, to a certain extent, balance heat displacement resistance, storage stability, and electrical charge stability etc. and achieve a better combination of properties. However, limited by the toner structure and/or its preparation, the current core-shell structured toners have many shortcomings and need to be improved. For instance, the current core-shell structured toners have single core-shell structures. In the preparation of a single core-shell structured toner, the sphericity is relatively difficult to control and it is very easy for sphere-shaped toner to form. Although sphere-shaped toners give high quality images of both good uniformity and color reproducibility, they have low friction force on the contacting points in the commonly used scraper cleaning system and therefore cause poor cleaning performance. The toner residue on the photoreceptor surface causes the printing quality to vary with the extension of development time. More particularly, for the all-color toners which contain red, blue, yellow and black colors, when sphere-shaped toner is used, it is even more difficult to improve the cleaning performance, especially for the scraper cleaning systems. Further, there are increased needs for diverse and personal printings and thus different printing machines have different requirements on the sphericity and particle sizes of the toners. The single core-shell structured toners cannot meet the increased needs due to their limitation in controlling the sphericity.

Technical Problems

The current preparation methods of the core-shell structured toners are complicated. They are limited in controlling the particle diameter distribution and sphericity and cannot meet the requirements in controlling the particle shape and size distribution required by various printing machines. In addition, the current preparation methods often require high temperature in the core forming or polymerization processes, which causes high energy consumption, increases costs, increases organic solvents evaporation and deteriorates the production environment.

U.S. Pat. No. 6,033,822 discloses a core-shell structure toner prepared by suspension polymerization. The suspension polymerization requires strong agitation to achieve proper particle size and it thus easily causes the broad particle size distribution of the toner and produces disassociated wax. The toner particles prepared according to the disclosed method are essentially spherical in shape. The method has difficulty controlling the sphericity. If the wax appears on the surface of the toner, it will very easily adhere to the scraper, photosensitive drum or other parts of the equipment and cause printing quality defects.

Chinese Pat. Pub. No. CN1834793A discloses an emulsion polymerization method for preparing the core-shell structured toner particles. However, this method requires a high temperature melting step, and it easily forms sphere-shaped toner particles and causes the toner to have poor cleaning performance.

Solution to the Technical Problems

One object of the invention is to provide a toner of improved structure.

To solve the above technical problem, the invention provides a toner having a honeycomb-shaped core-shell structure which comprises two or more core layers and each core layer is completely covered by a shell layer.

Preferably, the number of the core layers of the toner is within the range of 2 to 30; 2 to 30 core layers can help control the shape of the toner and achieve improved cleaning performance without adverse effect on the transfer printing rate. Too many core layers make it difficult to control the shape and particle diameter of the toner.

The average particle diameter of the toner of the invention can be within the range of 3 to 10 μm, preferably within the range of 5~8 μm. If the particle size of the toner is too small, its cleaning performance will be reduced. If the particle size of the toner is too big, the fine lace reproducibility will be reduced.

The shell layers of the toner completely cover the wax and colorant, etc. A proper shell layer thickness allows the wax to have the fixing function but not to leak out to cause a negative effect. A proper shell layer thickness allows the colorant to have the coloration function but not to affect electrical performance. The shell layer thickness of the toner of the invention can be within the range of 0.01 μm to 5 μm. If the shell layer is too thin, the wax and other core layer components cannot be completely covered. If the wax is exposed on the surface of the toner particles, it will readily adhere on the powder outlet knife, the photosensitive drum or other parts and cause printing quality defects. If the colorant is exposed to the surface of the toner particles, it is very likely to cause instability of the electrical charge performance of the toner particles and affect the coloration and fixing function of the toner. The shell layer thickness of the toner particles of the invention is preferably within the range of 0.1 to 2 μm, and more preferably within the range of 0.1 to 1 μm. This thickness will allow complete coverage of the colorant and wax, etc. but not affect the coloration and fixing performance of the toner. Furthermore, this thickness can reduce energy required by the melting process of the shell layer and reduce energy in the printing process.

The sphericity of the multiple core-shell structured toner of the invention can be within the range of 0.7 to 1.0, preferably within the range of 0.96 to 0.994. When the sphericity equals to 1.0, the toner is completely sphere-shaped. Smaller sphericity means the shape is less like a sphere. If the sphericity is too high, it will affect the cleaning performance of the toner; if the sphericity is too low, it will affect the developing ability and transfer printing ability. The sphericity used in this invention can be measured by OMC PIP9.1 Particle Image Processing Instrument. The sphericity $\phi$ equals to the ratio of the surface area of a sphere object which has the same volume as the measured object to the surface area of the measured object. For instance, depending on different printing requirements, the multiple core-shell structured toner of the invention can be completely sphere-shaped, and can also be peanut-shaped, strawberry-shaped, potato-shaped, or other non-sphere shapes. The peanut-shaped, strawberry-shaped, and potato-shaped toners not only have similar fluidity and revolving ability to the sphere-shaped toners, but can also enhance the friction at the contacting point and thus provide the toners with good developing and transfer printing ability and good cleaning performance.

Preferably, the multiple core-shell structured toner of the invention has an average shape factor SF-2 within the range of 100 to 200, more preferably within the range of 110 to 160.

The multiple core-shell structured toner of the invention, no matter sphere-shaped or non-sphere shaped, have good surface evenness. This invention uses shape factor SF-2 to indicate the surface roughness. SF-2 can be calculated based on the following equation:

$$SF\text{-}2=(P2/A)\times(1/4)\times100\pi$$

wherein P and A represent perimeter and area, respectively, of the projection of the toner particles on a two-dimensional surface. On an average, about 100 particles will be measured to determine the shape factor of the toner. When the shape factor is 100, the surface of the toner particles is not rough. The greater the shape factor, the rougher the surface of the toner particles. When the surface of the toner is too rough, the toner cannot be evenly charged, which results in reduced image quality.

Another object of the invention is to provide a method for the preparation of the toner of the invention.

To achieve the above object, the invention provides a method for the preparation of a honeycomb-shaped, core-shell structured toner having two or more core layers, each of which is completely covered by shell layers. The method comprises the following steps:

A. Dispersing a core-forming binding resin, colorant, anti-coagulation agent and emulsifier, etc. in an organic solvent to form an oil phase dispersing liquid, and then adding water to the dispersing liquid to emulsify it and to form a mixture emulsion;

B. Under shearing, adding a coagulating agent to the above mixture emulsion from step A to form a dispersion of the coagulated core particles;

C. Adding a shell-forming binding resin particle-containing shell-forming binding resin dispersion to the dispersion of the coagulated core particles from step B to form shells surrounding the coagulated core particles by the shell-forming binding resin particles and obtaining a dispersion of the coagulated core-shell structured particles;

D. to the dispersion of the coagulated core-shell structured particles from step C, adding a coagulating agent to cause the core-shell structured, coagulated particles to merge to form honeycomb-shaped, core-shell structured toner particles, wherein the sphericity of the toner particles is controlled by varying the coagulating time; and E. precipitating, washing, filtrating, and vacuum-drying the toner particles from step D yielding a honeycomb-shaped, core-shell structured toner having two or more core layers, each of which is covered by a shell layer.

In the above method, the single core-shell structured toner particles are first formed. The addition of the coagulating agent and agitation make the single core-shell structured toner particles collide with each other. With extension of coagulating time, the collided particles are gradually fused together to form a honeycomb-shaped, multiple core-shell structured toner. In this process, the sphericity and average particle diameter of the toner particles can be controlled by the coagulating time, the agitation time and the agitation rate. For instance, when the coagulating time is short, the collision time is also short, and the particles are partially fused to form non-sphere shapes. The longer the coagulating time, the more particles are fused together to form sphere-shaped toner particles with the sphericity of close to 1.0; when the coagulating time is sufficiently long, the particles become sphere-shaped. The higher the agitation rate, the smaller the average particle diameter. Increasing the agitation rate and agitation time will increase the number of coagulated particles and thus increase the average particle size. Therefore, the method of the invention can conveniently control the sphericity and the average particle diameter according to the requirements by properly controlling the coagulating time, agitation rate and agitation time. Because the sphericity of the toner particles affects the cleaning performance, transfer printing performance, and electric charge property, etc. and because the method of the invention can relatively conveniently control the sphericity, the invention can conveniently produce various toners according to unique requirements of the printing machines. Usually the agitation remains during the coagulation process and thus the coagulating time and the agitation time are equal. However, the invention is not so limited. If needed, the coagulating time can be longer or shorter than the agitation time.

Furthermore, in step C, the shell-forming emulsion that contains the shell-forming binding resin can be directly added in the core-shell formation step to coagulate the shell-forming binding resin onto the surface of the core. This is a physical process and it does not involve initiator, and thus it leaves no residual monomer and initiator in the toner.

In addition, the entire preparation process has no special temperature requirement; the temperature can be within the range of 5 to 40 C, preferably within the range of 20 to 30° C. The temperature control is easy and the energy consumption is low. Also, in step C, the shell thickness can be conveniently controlled by varying the particle diameter of the coagulated core particles or the concentration or the amount of the dispersion of the shell-forming particles. For instance, the higher the shell-forming particles concentration in the dispersion of the shell-forming particles, the thicker the shell layers will be. Preferably, the thickness of the shell layers is within the range of 0.01 to 5 μm.

Preferably, in step B, the average particle diameter of the coagulated core particles is within the range of 1 μm. to 5 μm. In the core preparation of step B, the core particles are formed as a microemulsion so that the size of the core particles can be varied relatively easily depending on the requirements. Also, when the average particle diameter of the coagulated core particles falls within this range, the coagulation in step D becomes more desirable and the formation of single core-shell structured toner particles can be avoided.

The invention has no specific requirements for the selection and amount to be used of colorants, binding resins, charge-controlling agents, waxes, emulsifiers and organic solvents and common knowledge in the art can be followed.

Suitable colorants can be selected from the colorants known in the art, including blue, green, red, purple and yellow colorants, the like, and mixtures thereof. The carbon type colorants include carbon black, the chromium type colorants include chrome yellow, the azo type colorants include Hansa yellow, permanent red FR4 and diaminodiphenyl yellow, the ferrocyanide type colorants include iron blue, the phthalocyanine type colorants include copper phthalocyanine and derivatives, alizarol saphirol 15, and phthalo greens, and the perylene type colorants include paratonere and pigment purple etc.

Suitable binding resins can be selected from any known toner resins, including polyester resins, vinyl resins, urethane resins, epoxy resins, the like, and mixtures thereof. Preferably, the core-forming binding resin is selected from polyester resins, vinyl resins, urethane resins, epoxy resins, the like, or mixture thereof. In addition, two or more resins having different molecular weights can be used. For the same type of resins, they may have different properties such as molecular weights and monomeric compositions, etc. Preferably, the resins are thermoplastic and compatible. The shell-forming binding resins can be the same types of resins as the core-forming binding resins, but preferably the shell-forming resins have higher glass transition temperatures than the core-forming binding resins.

Suitable charge-controlling agents can be selected from the known charge-controlling agents, including boron-containing equipped salts, chlorinated polyesters, chromic organic dyes, azo metal complexes, metal salts of benzoic acid, metal salts of salicylic acid and derivatives, sulfo group-containing copolymers, the like, and mixtures thereof.

Suitable waxes can be selected from the group consisting of natural waxes such as carnauba wax and rice bran wax, synthetic waxes such as polypropylene wax, polyethylene wax, oxidized polyethylene wax and oxidized polypropylene wax, coal waxes such as montan wax, petroleum waxes such as paraffin wax, ceresine wax and ozocerite, alcoholic waxes, polyester waxes, animal waxes, the like, and mixtures thereof.

Suitable coagulating agents can be selected from inorganic metal salts and metal complexes including sodium, potassium, lithium, magnesium, calcium, zinc, copper, cobalt, beryllium and strontium haloids, sulfates, acetates and acetyl acetates, and aluminum, iron and chromium complexes. This invention has no strict limitation on the amount of coagulating agent and it may vary depending on the required sphericity and particle size. In general, if the amount of the coagulating agent is too high, the combination of the particles becomes fast, the particle growth easily becomes uneven, the particles become sphere-shaped within a relatively short period of agitation, and thus the control of the sphericity becomes difficult. If the amount of the coagulating agent is insufficient, the coagulation becomes insufficient and single core-shell structured particles are likely to form.

Suitable emulsifier can be any known emulsifier, including sodium dodecyl sulfate, sodium tetradecanesulfonate, sodium pentadecyl sulfate, sodium octyl sulfate, sodium oleate, sodium undecylenate, potassium stearate, potassium oleate, lauryl ammonium chloride, lauryl ammonium bromide and poly(ethylene oxide), the like, and mixtures thereof.

Suitable organic solvents can be ketones, alcohols, esters or mixtures thereof. Preferably, the organic solvent is selected from $C_1$-$C_6$ ketones, alcohols and ethers, including acetone, butanone, methanol, ethanol, isopropyl alcohol, methyl acetate, ethyl acetate and butyl acetate, etc.

In the preparation of the toner of the invention, essentially all of the single core-shell structured particles are coagulated. The coagulation of the single core-shell structured particles depends, to a certain degree, on the core size, the amount of coagulating agent used and the thickness of the core layers. For instance, the larger the core size, the smaller the number of the particles that will be coagulated, and the greater the possibility for the existence of the single core-shell structured particles will be. Thicker shell layers or insufficient amount of the coagulating agent may also result in the single core-shell structured toner particles. Therefore, some single core-shell structured particles may occasionally exist in the toner, if so, preferably less than 20%.

Effectiveness of the Invention

The toner particles of the invention have multiple core layers and each of the core layers and the shell layer which covers the core layer form a honeycomb unit, wherein two adjacent honeycomb units share a shell layer, and therefore the overall structure of the toner particles is like a honeycomb shape. Because the structure of the toner comprises multiple honeycomb units, the sphericity and particle size of the toner can be relatively conveniently controlled by varying the number of the honeycomb units as required by the printing equipment to achieve a balanced performance and printing quality including the image uniformity, color reproducibility and printing cleaning, etc. In addition, because the core layers of the core-shell structured toner are softer than the shell layers, the shell layers which cover each of the core layers protect the core layers.

Figure 1:
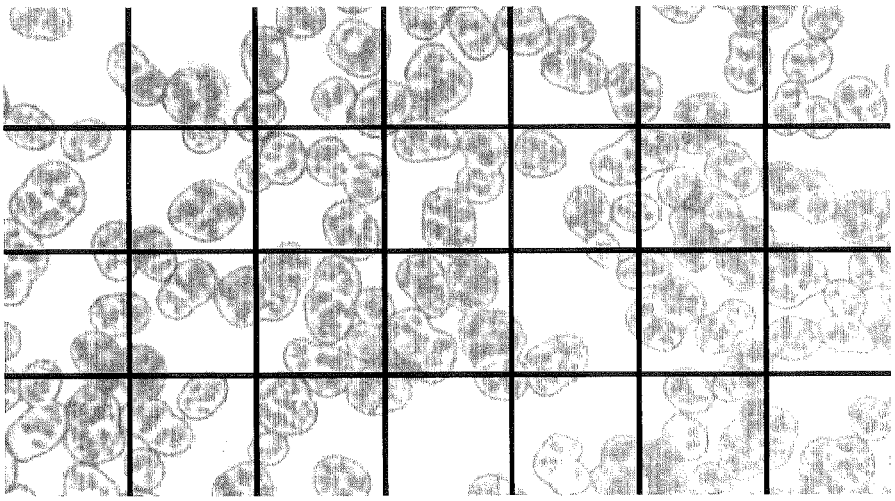
FIG. 1 is a microscopic image of the toner of Example 2 of the invention.
Figure 2:
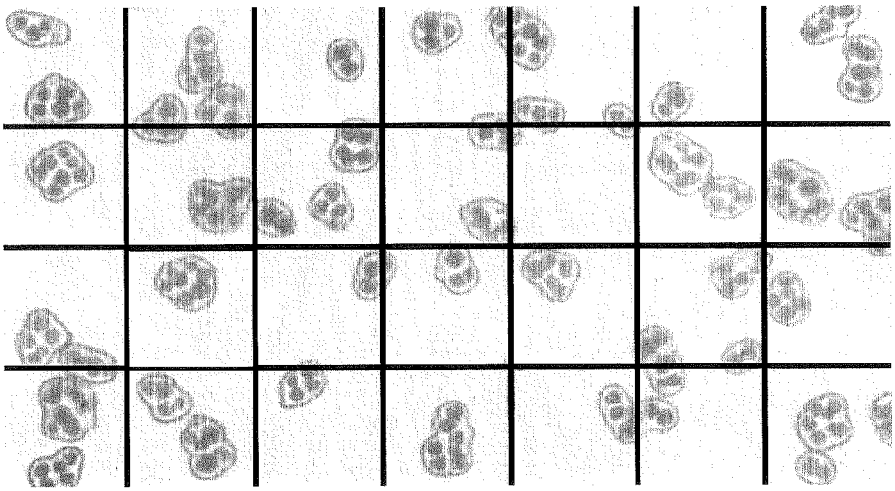
FIG. 2 is a microscopic image of the toner of Example 3 of the invention.

The invention is further illustrated by the combination of the figures and the prefer examples as follows.

EXAMPLES

The honeycomb-shaped, multiple core-shell structured toner particles of the invention can be preferably prepared as follows.

A. Preparation of the Mixture Emulsion

Colorant (1-10 parts by weight), wax (0.5-20 parts by weight), binding resin (100-200 parts by weight) and emulsifier (0-2 parts by weight) are dispersed in an organic solvent (50-150 parts by weight) with agitation (3000-10,000 rpm for about an hour) to form an oil phase dispersion; while the oil phase dispersion remains at a temperature of about 30° C.; deionized water (100-200 parts by weight) is added to it to form a mixture emulsion.

B. Preparation of Dispersion of Coagulated Core Particles.

Coagulating agent (1-3% by weight of the mixture emulsion) is added to the mixture emulsion with agitation (400-600 rpm) to form coagulated core particles.

The amount of the coagulating agent varies depending on the desired particle size and the type of the coagulating agent used. For a strong coagulating agent, its amount can be low and for a weak coagulating agent, the amount can be increased.

C. Preparation of Dispersion of Core-Shell Structured, Coagulated Particles

A dispersion containing shell-forming binding resin particles is added to the dispersion of the coagulated core particles to cause the shell-forming particles to adhere on the surface of the coagulated core particles.

Examples of the shell-forming particles include resin particles, colorant particles, wax particles, and other component particles. The shell-forming particle dispersion may include a resin dispersion which contains resin particles, a colorant dispersion which contains colorant particles, a wax dispersion which contains wax particles, and other dispersions which contain other component particles. These particle dispersions can be used alone or in combination of two or more.

A charge control agent can be added to the shell-forming particles. The charge control agent, which stays on the outside layer of the toner particles, enhances the efficiency of the charge control agent.

The resin particles of the shell-forming particles dispersion preferably have a glass transition temperature higher than that of the core-forming resin particles in order to provide improved storage stability.

Preferably, the average particle diameter of the shell-forming particles is less than or equal to 1 μm. If the average particle diameter is greater than 1 μm, some particles may stay free.

The addition mode of the shell-forming particles is not critical; it can be continuous or batchwise.

The thickness of the shell can be within the range of 0.01 to 5 μm, preferably 0.1 to 2 μm, more preferably 0.1 to 1 μm. If the shell layer is too thin, the colorant, wax and other components may not be fully covered; if the shell layer is too thick, it will affect the coloration, fixing and other performance of the toner.

D. Preparation of the Dispersion of the Coagulated Multiple Core-Shell Structured Particles After the shell-forming particles adhere on the surface of the coagulated core particles, coagulating agent (0.1 to 20% by weight of the dispersion) is added to the dispersion with agitation for 0.1 to 30 minutes to merge the single core-shell structured particles into honeycomb-shaped, multiple core-shell structured coagulated toner particles. The sphericity of the toner particles is controlled by the coagulation time. In this step, the coagulation time essentially equals the agitation time. In the following examples, the coagulation time is also essentially equal to the agitation time unless stated otherwise.

E. Isolation and Purification

The coagulated toner particles are washed with water and filtrated several times to remove other unnecessary components. The washed toner particles are dried under vacuum at a low temperature. Other additives may be added to the dried toner particles to yield the final toner product.

The toner product prepared according to the above method has a sphericity within the range of 0.7 to 1.0 μm, average particle diameter within the range of 5 μm to 8 μm, average shape factor within the range of 110 to 130, shell layer thickness within the range of 0.01 to 1 μm, and the number of core layers within the range of 2 to 30 μm, and it essentially does not contain single core-shell structured particles.

The following examples further illustrate the invention, but do not limit the scope of the invention.

EXAMPLE 1

Preparation of Dispersion of Coagulated Core Particles

Copper Phthalocyanine Blue (5 parts by weight), polypropylene wax ($T_g$: 61° C., 8 parts by weight), sodium tetradecylsulfonate (0.8 parts by weight) and polyester resin (140 parts by weight) are added in methyl ethyl ketone (80 parts by weight). The mixture is emulsified with emulsification equipment with high shearing force for one hour. While the temperature remains at about 30° C., deionized water (150 parts by weight) is added to the above mixture to form the mixture emulsion.

The above emulsion is charged into a reactor and agitated at a rate of 400 to 600 rpm. 1% magnesium chloride solution is added to the reactor mixture (30 parts by weight) as a coagulating agent. After the magnesium chloride is added, the agitation continues for an additional 30 minutes to yield the coagulated core particles having an average particle diameter of 4.2 μm.

Preparation of the Shell-Forming Particles Dispersion:

Polyester resin ($T_g$: 66° C., 20 parts by weight) and sodium tetradecylsulfonate (0.6 parts by weight) are added to methyl ethyl ketone (30 parts by weight) in emulsification equipment with high shearing force for one hour; while the temperature remains at about 30° C., deionized water (70 parts by weight) is added to the mixture to yield the shell-forming particles dispersion.

Adding the above shell-forming particles dispersion to the coagulated core particles dispersion and keeping the mixture for 30 minutes yields the coagulated core-shell structured particles dispersion having an average particle size of 4.3 μm.

To the above dispersion, 1% magnesium chloride (10 parts by weight) is added as a coagulating agent, and the mixture is agitated for 10 minutes. When the sphericity and particle size meet the requirements of the toner, deionized water (500 parts by weight) is added to yield coagulated honeycomb-shaped multiple core-shell structured toner particles.

The above coagulated toner particles are washed with water three or more times. After filtration, the coagulated toner particles are dried under a vacuum at a temperature below 40° C. and yield honeycomb-shaped multiple core-shell structured blue toner particles. Microscopic image indicates that the blue toner particles of this Example have 2-30 core layers and essentially have single core-shell structures; each core layer is covered by a shell layer; and the overall toner particles are honeycomb-shaped. The blue toner particles of this Example have a volume-averaged particle diameter of 7.6 μm, sphericity of 0.978, average shape factor of 116, and shell layer thickness of 0.1 μm.

EXAMPLE 2

Preparation of Dispersion of Coagulated Core Particles

Copper Phthalocyanine Blue (5 parts by weight), polypropylene wax ($T_g$: 61° C., 8 parts by weight), sodium tetradecylsulfonate (0.8 parts by weight) and polyester resin (120 parts by weight) are added in methyl ethyl ketone (80 parts by weight). The mixture is emulsified in emulsification equipment with high shearing force for one hour. While the temperature remains at about 30° C., deionized water (150 parts by weight) is added to the above mixture to form the emulsion mixture.

The above emulsion is charged into a reactor and agitated at a rate of 400 to 600 rpm. 1% magnesium chloride solution (30 parts by weight) is added to the reactor mixture as a coagulating agent. After the magnesium chloride is added, the agitation continues for an additional 30 minutes to yield the coagulated core particles having an average particle diameter of 4.2 μm.

Preparation of the Shell-Forming Particles Dispersion:

Polyester resin ($T_g$: 66° C., 40 parts by weight) and sodium tetradecylsulfonate (0.6 parts by weight) are added to methyl ethyl ketone (30 parts by weight) in emulsification equipment with high shearing force for one hour; while the temperature remains at about 30° C., deionized water (70 parts by weight) is added to the mixture to yield the shell-forming particles dispersion.

Adding the above shell-forming particles dispersion to the coagulated core particles dispersion and keeping the mixture for 30 minutes yields the coagulated core-shell structured particles dispersion having an average particle size of 4.5 μm.

1% magnesium chloride (10 parts by weight) is added to the above dispersion as a coagulating agent, and the mixture is agitated for 10 minutes. When the sphericity and particle size of the particles meet the requirements of the toner, deionized water (500 parts by weight) is added to yield the coagulated honeycomb-shaped multiple core-shell structured toner particles.

The above coagulated toner particles are washed with water three or more times. After filtration, the coagulated toner particles are dried under a vacuum at a temperature below 40° C. and yield tomato-like, honeycomb-shaped multiple core-shell structured blue toner particles. FIG. 1 is a microscopic image of the blue toner particles of this Example. FIG. 1 indicates that the blue toner particles of this Example have 2-30 core layers and essentially have no single core-shell structure; each core layer is covered by a shell layer; and the overall toner particles are honeycomb-shaped. The blue toner particles of this Example have a volume-averaged particle diameter of 7.6 μm, sphericity of 0.975, average shape factor of 118, and shell layer thickness of 0.25 μm.

EXAMPLE 3

Preparation of Dispersion of Coagulated Core Particles

Copper Phthalocyanine Blue (5 parts by weight), polypropylene wax ($T_g$: 61° C., 8 parts by weight), anionic emulsifier (0.8 parts by weight) and polyester resin (100 parts by weight) are added in methyl ethyl ketone (80 parts by weight). The mixture is emulsified in emulsification equipment with high shearing force for one hour. While the temperature remains at about 30° C., deionized water (150 parts by weight) is added to the above mixture to form the mixture emulsion.

The above emulsion is charged into a reactor and agitated at a rate of 400 to 600 rpm. 1% magnesium chloride solution (30 parts by weight) is added to the reactor mixture as a coagulating agent. After the magnesium chloride is added, the agitation continues for an additional 30 minutes to yield the coagulated core particles having an average particle diameter of 4.2 μm.

Preparation of the Shell-Forming Particles Dispersion:

Polyester resin (60 parts by weight) and anionic emulsifier (0.6 parts by weight) are added to methyl ethyl ketone (30 parts by weight) in emulsification equipment with high shearing force for one hour; while the temperature remains at about 30° C., deionized water (70 parts by weight) is added to the mixture to yield the shell-forming particles dispersion.

Adding the above shell-forming particles dispersion to the coagulated core particles dispersion and keeping the mixture for 30 minutes yields the coagulated core-shell structured particles dispersion having an average particle size of 4.7 μm.

1% magnesium chloride (10 parts by weight) is added to the above dispersion as a coagulating agent, and the mixture is agitated for 10 minutes. When the sphericity and particle size meet the requirements of the toner, deionized water (500 parts by weight) is added to yield coagulated honeycomb-shaped multiple core-shell structured toner particles.

Figure 3:
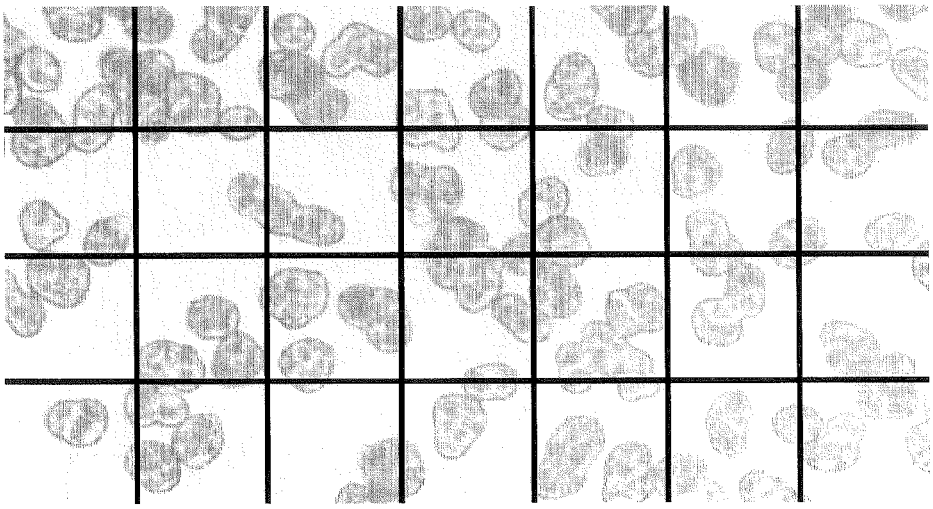
FIG. 3 is a microscopic image of the toner of Example 4 of the invention.

The above coagulated toner particles are washed with water three or more times. After filtration, the coagulated toner particles are dried under a vacuum at a temperature below 40° C. and yield honeycomb-shaped multiple core-shell structured blue toner as indicated by FIG. 3, which has a volume-averaged particle diameter of 7.6 μm, sphericity of 0.976, average shape factor of 118, and shell layer thickness of 0.5 μm. Compared to Example 2, this Example increases the amount of the shell-forming particles and thereby conveniently adjusts the shell layer thickness.

EXAMPLE 4

This Example essentially follows Example 2, except that Paintco Red 122, instead of Copper Phthalocyanine Blue, is used and it yields a honeycomb-shaped multiple core-shell structured red toner. FIG. 3 is a microscopic image of the red toner of this Example, which indicates that the red toner particles have 2-30 core layers and essentially have no single core-shell structure; each core layer is covered by a shell layer; and the overall red toner particles are honeycomb-shaped. The toner particles have a volume-averaged particle diameter of 7.6 μm, sphericity of 0.985, average shape factor of 117, and shell layer thickness of 0.25 μm.

EXAMPLE 5

This Example essentially follows Example 2, except that Pigment Yellow 17, instead of Copper Phthalocyanine Blue, is used and it yields honeycomb-shaped multiple core-shell structured yellow toner particles. Microscopic image of the yellow toner particles of this Example indicates that the particles have 2-30 core layers and essentially have no single core-shell structure; each core layer is covered by a shell layer; and the overall yellow toner particles are honeycomb-shaped. The toner particles have a volume-averaged particle diameter of 7.4 μm, sphericity of 0.974, average shape factor of 115, and shell layer thickness of 0.25 μm.

EXAMPLE 6

This Example essentially follows Example 2, except that carbon black, instead of Copper Phthalocyanine Blue, is used and it yields honeycomb-shaped multiple core-shell structured black toner particles. Microscopic image of the black toner particles of this Example indicates that the black toner particles have 2-30 core layers, essentially have no single core-shell structure, each core layer is covered by the shell layer, and the overall yellow toner particles are honeycomb-shaped. The black toner particles have a volume-averaged particle diameter of 7.5 μm, sphericity of 0.981, average shape factor of 115, and shell layer thickness of 0.25 μm.

EXAMPLE 7

Preparation of Dispersion of Coagulated Core Particles

Copper Phthalocyanine Blue (5 parts by weight), polypropylene wax (8 parts by weight), anionic emulsifier (0.8 parts by weight) and polyester resin (120 parts by weight) are added in methyl ethyl ketone (80 parts by weight). The mixture is emulsified in emulsification equipment with high shearing force for one hour. While the temperature remains at about 30° C., deionized water (150 parts by weight) is added to the above mixture to form the mixture emulsion.

The above emulsion is charged into a reactor and agitated at a rate of 400 to 600 rpm. 1% magnesium chloride solution (30 parts by weight) is added to the reactor mixture as a coagulating agent. After the magnesium chloride is added, the agitation continues for an additional 30 minutes to yield the coagulated core particles having an average particle diameter of 4.1 μm. \

Preparation of the Shell-Forming Particles Dispersion:

Polyester resin (40 parts by weight) and anionic emulsifier (0.6 parts by weight) are added to methyl ethyl ketone (30 parts by weight) in emulsification equipment with high shearing force for one hour; while the temperature remains at about 30° C., deionized water (70 parts by weight) is added to the mixture to yield the shell-forming particles dispersion.

Adding the above shell-forming particles dispersion to the coagulated core particles dispersion and keeping the mixture for 30 minutes yields the coagulated core-shell structured particles dispersion having an average particle size of 4.4 μm.

1% magnesium chloride (10 parts by weight) is added to the above dispersion as a coagulating agent, and the mixture is agitated for 40 minutes. Deionized water (500 parts by weight) is added to yield coagulated honeycomb-shaped multiple core-shell structured toner particles.

The above coagulated toner particles are washed with water three or more times. After filtration, the coagulated toner particles are dried under a vacuum at a temperature below 40° C. and yield honeycomb-shaped multiple core-shell structured blue toner particles. Microscopic image indicates that the blue toner particles of this Example have 2-30 core layers, have essentially no single core-shell structure, each core layer is covered by the shell layer, and the overall toner particles are honeycomb-shaped. The toner particles have a volume-averaged particle diameter of 7.6 μm, sphericity of 0.995, average shape factor of 102, and shell layer thickness of 0.25 μm. Compared to Example 2, this Example increases the amount of the coagulation time and agitation time and thus yields sphere-like toner particles. This Example indicates that the method of the invention can conveniently control the particle sphericity.

EXAMPLE 8

Preparation of Dispersion of Coagulated Core Particles

Copper Phthalocyanine Blue (5 parts by weight), polypropylene wax (8 parts by weight), anionic emulsifier (0.8 parts by weight) and polyester resin (140 parts by weight) are added in methyl ethyl ketone (60 parts by weight). The mixture is emulsified in emulsification equipment with high shearing force for one hour. While the temperature remains at about 30° C., deionized water (150 parts by weight) is added to the above mixture to form the mixture emulsion.

The above emulsion is charged into a reactor and agitated at a rate of 400 to 1000 rpm. 1% magnesium chloride solution (30 parts by weight) is added to the reactor mixture as a coagulating agent. After the magnesium chloride is added, the agitation continues for an additional 30 minutes to yield the coagulated core particles having an average particle diameter of 4.2 μm.

Preparation of the Shell-Forming Particles Dispersion:

Polyester resin (20 parts by weight), chlorinated polyester resin (1.5 parts by weight) and anionic emulsifier (0.6 parts by weight) are added to methyl ethyl ketone (30 parts by weight) in emulsification equipment with high shearing force for one hour; while the temperature remains at about 30° C., deionized water (75 parts by weight) is added to the mixture to yield the shell-forming particles dispersion.

Adding the above shell-forming particles dispersion to the coagulated core particles dispersion and keeping the mixture for 30 minutes yields coagulated core-shell structured particles dispersion having an average particle size of 4.3 μm.

1% magnesium chloride (10 parts by weight) is added to the above dispersion as a coagulating agent, and the mixture is agitated for 10 minutes. When the sphericity and particle size meet the requirements, deionized water (500 parts by weight) is added to yield coagulated honeycomb-shaped multiple core-shell structured toner particles.

Figure 4:
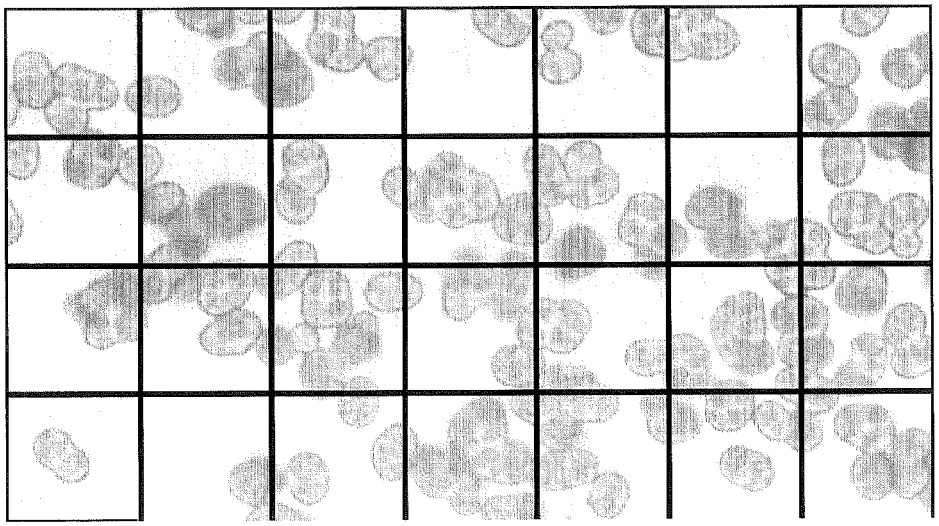
FIG. 4 is a microscopic image of the toner of Example 8 of the invention.

The above coagulated toner particles are washed with water three or more times. After filtration, the coagulated toner particles are dried under vacuum at a temperature below 40° C. and yield honeycomb-shaped multiple core-shell structured blue toner particles. FIG. 4 is a microscopic image of the toner particles of this Example, which indicates that the toner particles have 2-30 core layers, have essentially no single core-shell structure, each core layer is covered by a shell layer, and the overall toner particles are honeycomb-shaped. The toner particles have a volume-averaged particle diameter of 7.5 μm, sphericity of 0.974, average shape factor of 120, and shell layer thickness of 0.1 μm.

COMPARATIVE EXAMPLE 1

Preparation of Dispersion of Coagulated Core Particles

Copper Phthalocyanine Blue (5 parts by weight), polypropylene wax (8 parts by weight), anionic emulsifier (0.8 parts by weight) and polyester resin (120 parts by weight) are added in methyl ethyl ketone (80 parts by weight). The mixture is emulsified in emulsification equipment with high shearing force for one hour. While the temperature remains at about 30° C., deionized water (150 parts by weight) is added to the above mixture to form the mixture emulsion.

The above emulsion is charged into a reactor and agitated at a rate of 400 to 600 rpm. 1% magnesium chloride solution (60 parts by weight) as a coagulating agent is added to the reactor mixture. After the magnesium chloride is added, the agitation continues for an additional 30 minutes to yield the coagulated core particles having an average particle diameter of 7.2 μm.

Preparation of the Shell-Forming Particles Dispersion:

Polyester resin (40 parts by weight and anionic emulsifier (0.6 parts by weight) are added to methyl ethyl ketone (30 parts by weight) in emulsification equipment with high shearing force for one hour; while the temperature remains at about 30° C., deionized water (70 parts by weight) is added to the mixture to yield the shell-forming particles dispersion.

Adding the above shell-forming particles dispersion to the coagulated core particles dispersion and keeping the mixture for 30 minutes yields coagulated core-shell structured particles dispersion.

The above coagulated toner particles are washed with water three or more times. After filtration, the coagulated toner particles are dried under vacuum at a temperature below 40° C. to yield single core-shell structured blue toner particles which have a volume-averaged particle diameter of 7.5 μm, sphericity of 0.996, and average shape factor of 101.

The toners of Examples 1-8 and Comparative Example 1 are tested for printing qualities including image density, background fog density, transfer printing rate and cleaning performance.

1. Test Methods (1) Image density: measured by Spectrodensitometer (X-Rite 938, product of X-Rite Inc.). All of the tested images are printed by a digital all-color printer with the respective toners.

(2) Background fog density: tested and assessed by spectrodensitometer. The procedures are as follows. The concentration is measured by spectrodensitometer at a given area of a standard paper. A solid 5×5 cm picture is printed on an up part of the given area and then the concentration is measured by spectrodensitometer on the low part of the given area (within the given area but outside the printed picture). The difference between the measured concentrations on the up part and the low part is defined as the background fog density.

(3) Transfer printing rate: tested by measuring the amount of toner on the paper printed with standard picture or text (Mp) and its residue on the photoreceptor (Md) and calculated according to the following equation. The transfer printing rate of each toner is then measured against the standard.

$$\text{Transfer printing rate}=\{Mp/(Mp+Md)\}\times 100\%$$

(4) Cleaning performance: measured by forming a shadow toner image on the photoreceptor and then removing it by a cleaning blade, and determining whether there is any residual toner particles on the photoreceptor; testing conditions: temperature 25° C. and humidity 30% RH.

2. Assessment

Image density, background fog density and transfer printing rate are assessed by three grades: A means excellent, B means good and C means poor.

The results are shown in Table 1.

TABLE 1

| Example No. | Image Density | Background Fog Density | Transfer Printing Rate | Cleaning Performance |
|---|---|---|---|---|
| Ex. 1 | A | A | A | A |
| Ex. 2 | A | A | A | A |
| Ex. 3 | A | A | A | A |
| Ex. 4 | A | A | A | A |
| Ex. 5 | A | A | A | A |
| Ex. 6 | A | A | A | A |
| Ex. 7 | A | A | A | B |
| Ex. 8 | A | A | A | A |
| Ex. C. 1 | A | A | A | B |

The test results indicate that after printing 10,000 pages on a color laser printer, the toner of the invention has a transfer printing rate greater than 85% and image density greater than 1.20. The toner of the invention not only has improved transfer printing rate and image density, but also has reduced background fog density. The toner residue on the photoreceptor is also significantly reduced compared with the sphere-shaped toners, which means the cleaning performance of the toner of the invention is improved. After being stored in an oven at 45° C. for 24 hours, the toner of the invention shows no lumps, which means that the toner of the invention has good storage stability.

INDUSTRIAL APPLICABILITY

The toner of the invention has multiple core layers. Each core layer and its shell layer form a honeycomb unit. Two adjacent honeycomb units share a shell layer and thus the overall toner particles are honeycomb-shaped. Therefore, the sphericity and size of the toner particles can be easily controlled according to the requirements of the printing equipment by varying the number of the honeycomb units to achieve good image uniformity, color reproducibility, cleaning performance and other properties. In addition, the shell layer is harder than the core layer in the core-shell structured toner particles, the shell layer protects the core layer.

We claim:

1. A method for preparing a toner having honeycomb-shaped core-shell structured particles which comprise two or more core layers, each of which is completely covered by a shell layer, said method comprising:

(a) dispersing a core-forming binding resin, a colorant, and a dispersant in an organic solvent to form an oil phase dispersing liquid, adding water to the oil phase dispersing liquid to emulsify and form a mixture emulsion;

(b) under shearing, adding a coagulating agent to the resultant emulsion from step (a) to form a dispersion of the coagulated core particles;

(c) to the resultant dispersion from step (b), adding a shell-forming binding resin dispersion which contain shell-forming binding resin particles, wherein the shell-forming binding resin particles form shells surrounding the coagulated core particles and yield coagulated core-shell structured particles dispersion;

(d) to the coagulated core-shell structured particles dispersion from step (c), adding a coagulating agent to merge the coagulated core-shell structured particles into honeycomb-shaped, core-shell structured toner particles, wherein the sphericity of the toner particles is controlled by controlling the coagulating time; and (e) precipitating, washing, filtrating, and vacuum-drying of the toner particles from step (d) to yield honeycomb-shaped, core-shell structured toner particles having two or more core layers, each of which is covered by a shell layer.

2. The method of claim 1, wherein in step (a), the mixture emulsion is prepared by dispersing 1 to 10 parts of a colorant, 0.5 to 20 parts of a wax, 100 to 200 parts of a binding resin and 0 to 2 parts of an emulsifier in 50 to 150 parts of an organic solvent; agitating the above mixture at 3000 to 10000 rpm for about one hour to form an oil phase dispersing liquid, remaining the temperature at about 30° C., and then adding 100 to 200 parts of deionized water to emulsify the mixture and form a mixture emulsion.

3. The method of claim 1, wherein in step (b), the average particle diameter of the coagulated core particles is within the range of 1 μm to 5 μm.

4. The method of claim 3, wherein in step (a), the mixture emulsion is prepared by dispersing 1 to 10 parts of a colorant, 0.5 to 20 parts of a wax, 100 to 200 parts of a binding resin and 0 to 2 parts of an emulsifier in 50 to 150 parts of an organic solvent; agitating the above mixture at 3000 to 10000 rpm for about one hour to form an oil phase dispersing liquid, remaining the temperature at about 30° C., and then adding 100 to 200 parts of deionized water to emulsify the mixture and form a mixture emulsion.

5. The method of claim 3, wherein in step (c), the average diameter of the shell-forming particles in the shell-forming particles dispersion is less than or equal to 1 μm.

6. The method of claim 5, wherein in step (a), the mixture emulsion is prepared by dispersing 1 to 10 parts of a colorant, 0.5 to 20 parts of a wax, 100 to 200 parts of a binding resin and 0 to 2 parts of an emulsifier in 50 to 150 parts of an organic solvent; agitating the above mixture at 3000 to 10000 rpm for about one hour to form an oil phase dispersing liquid, remaining the temperature at about 30° C., and then adding 100 to 200 parts of deionized water to emulsify the mixture and form a mixture emulsion.

7. The method of claim 3, wherein step (d) is performed at an ambient temperature.

* * * * *